US008752844B1

(12) United States Patent
Walker et al.

(10) Patent No.: US 8,752,844 B1
(45) Date of Patent: Jun. 17, 2014

(54) SHOE MOBILITY SYSTEM

(76) Inventors: Gregory J. Walker, Lakewood, CO (US); Susan E. Walker, Lakewood, CO (US)

( * ) Notice: Subject to any disclaimer, the term of this patent is extended or adjusted under 35 U.S.C. 154(b) by 470 days.

(21) Appl. No.: 13/198,453

(22) Filed: Aug. 4, 2011

(51) Int. Cl.
*A63C 17/08* (2006.01)
*A63C 1/18* (2006.01)

(52) U.S. Cl.
USPC ..... 280/11.24; 280/11.3

(58) Field of Classification Search
USPC ..... 280/809, 841, 11.19, 11.24
See application file for complete search history.

(56) References Cited

U.S. PATENT DOCUMENTS

| | | | | | |
|---|---|---|---|---|---|
| 1,600,075 | A | * | 9/1926 | Stoops | 280/11.24 |
| 2,095,942 | A | * | 10/1937 | Wetterstrand | 280/7.13 |
| 3,112,119 | A | * | 11/1963 | Sweet | 280/11.209 |
| 3,374,002 | A | * | 3/1968 | Lewis | 280/11.24 |
| D231,999 | S | * | 7/1974 | Engman | D21/763 |
| D233,619 | S | * | 11/1974 | Engman | D21/763 |
| 5,273,304 | A | | 12/1993 | Berkheimer | |
| 5,797,609 | A | * | 8/1998 | Fichepain | 280/11.19 |
| D459,777 | S | | 7/2002 | Yang | |
| 6,719,304 | B2 | * | 4/2004 | Miller et al. | 280/11.27 |
| 7,621,540 | B2 | | 11/2009 | Adams | |
| 7,735,847 | B2 | | 6/2010 | Dougherty | |
| D681,759 | S | * | 5/2013 | Treadway et al. | D21/763 |
| 2004/0041359 | A1 | * | 3/2004 | Im | 280/11.25 |
| 2004/0239056 | A1 | | 12/2004 | Cho et al. | |
| 2007/0029742 | A1 | * | 2/2007 | Shing | 280/11.221 |
| 2008/0235990 | A1 | * | 10/2008 | Wegener | 36/100 |
| 2010/0051372 | A1 | | 3/2010 | Adams et al. | |
| 2012/0285756 | A1 | * | 11/2012 | Treadway | 180/65.51 |

* cited by examiner

*Primary Examiner* — J. Allen Shriver, II
*Assistant Examiner* — Bridget Avery

(57) ABSTRACT

A shoe mobility system for allowing a user's shoe to roll on a ground surface while the user is seated in a wheelchair. The system features a base panel connected to a back panel at an angle, wherein the panels are for positioned at the back and bottom area of a shoe. A pair of flanges extends from the back panel of the system, and an axle spans the flanges. A wheel is rotatably attached to the axle. The system is attachable to the user's shoe.

3 Claims, 4 Drawing Sheets

(Side View)

(Bottom View)

(Back View)

(In-use View)

(In-use Viewfor Men)

(In-use View for Women)

SHOE MOBILITY SYSTEM

FIELD OF THE INVENTION

The present invention is directed to a system for attaching to shoes to make the shoes

BACKGROUND OF THE INVENTION

People in wheelchairs often drag their feet while being pushed by a caregiver. Footrests may be inconvenient and cumbersome. The present invention features a shoe mobility system featuring a wheel that enables a user's shoe to roll on a ground surface. The system of the present invention provides a user (e.g., a patient) a comfortable means of resting his/her feet on the ground while being pushed around in a wheelchair. The system of the present invention is portable and easy to use.

SUMMARY

The present invention features a shoe mobility system. In some embodiments, the system comprises a base panel having a front edge and a back edge; a back panel having a top edge and a bottom edge, the bottom edge is connected to the back edge of the base panel, the back panel and the base panel are at an angle with respect to each other a first flange extending backwardly from a first side of the back panel near an intersection of the base panel and the back panel and a second flange extending backwardly from a second side of the back panel near the intersection of the base panel and the back panel; an axle spanning the flanges; and a wheel rotatably attached to the axle.

In some embodiments, the system further comprises a first half strap disposed on the base panel at or near a first side of the base panel, and a second half strap disposed on the base panel at or near a second side of the base panel, the half straps can engage each other to secure the system to a shoe. In some embodiments, the system further comprises a first side panel and a second side panel each connected to the base panel and the back panel such that the panels form a mold around a back area of a shoe. In some embodiments, the system further comprises a slot disposed in the back panel at or near the top edge, the slot is adapted to accept a secondary strap.

In some embodiments, the angle between the base panel and the back panel is about 90 degrees. In some embodiments, the angle between the base panel and the back panel is between about 80 to 110 degrees.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
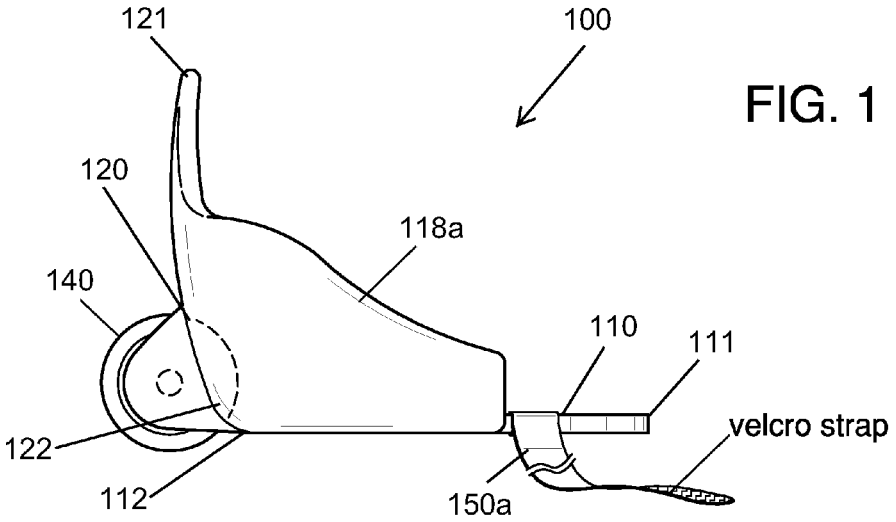
FIG. 1 is a side view of the system of the present invention.

Referring now to FIG. 1-6, the present invention features a shoe mobility system 100. The system 100 comprises a base panel 110 for positioning on the bottom surface of a user's shoe 101. The base panel 110 has a front edge 111 (facing the toe of the user's shoe 101) and a back edge 112. The system 100 comprises a back panel 120 for positioning on the back heel area of the user's shoe 101. The back panel 120 has a top edge 121 and a bottom edge 122. The back panel 120 is connected to the base panel 110 (e.g., at an angle, e.g., about perpendicularly), e.g., the bottom edge 122 of the back panel 120 meets the back edge 112 of the base panel 110.

Extending backwardly from the back panel 120 (at the intersection of the base panel 110 and the back panel 120) is a first flange 130*a* and a second flange 130*b*. An axle 146 spans the flanges 130. A wheel 140 is rotatably attached to the axle 146.

Figure 4:
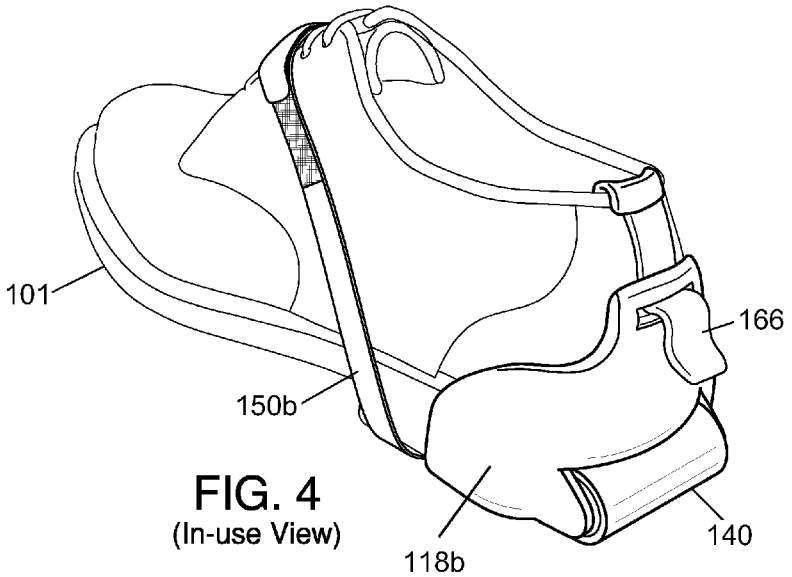
FIG. 4 is a perspective in-use view of the system of the present invention.
Figure 5:
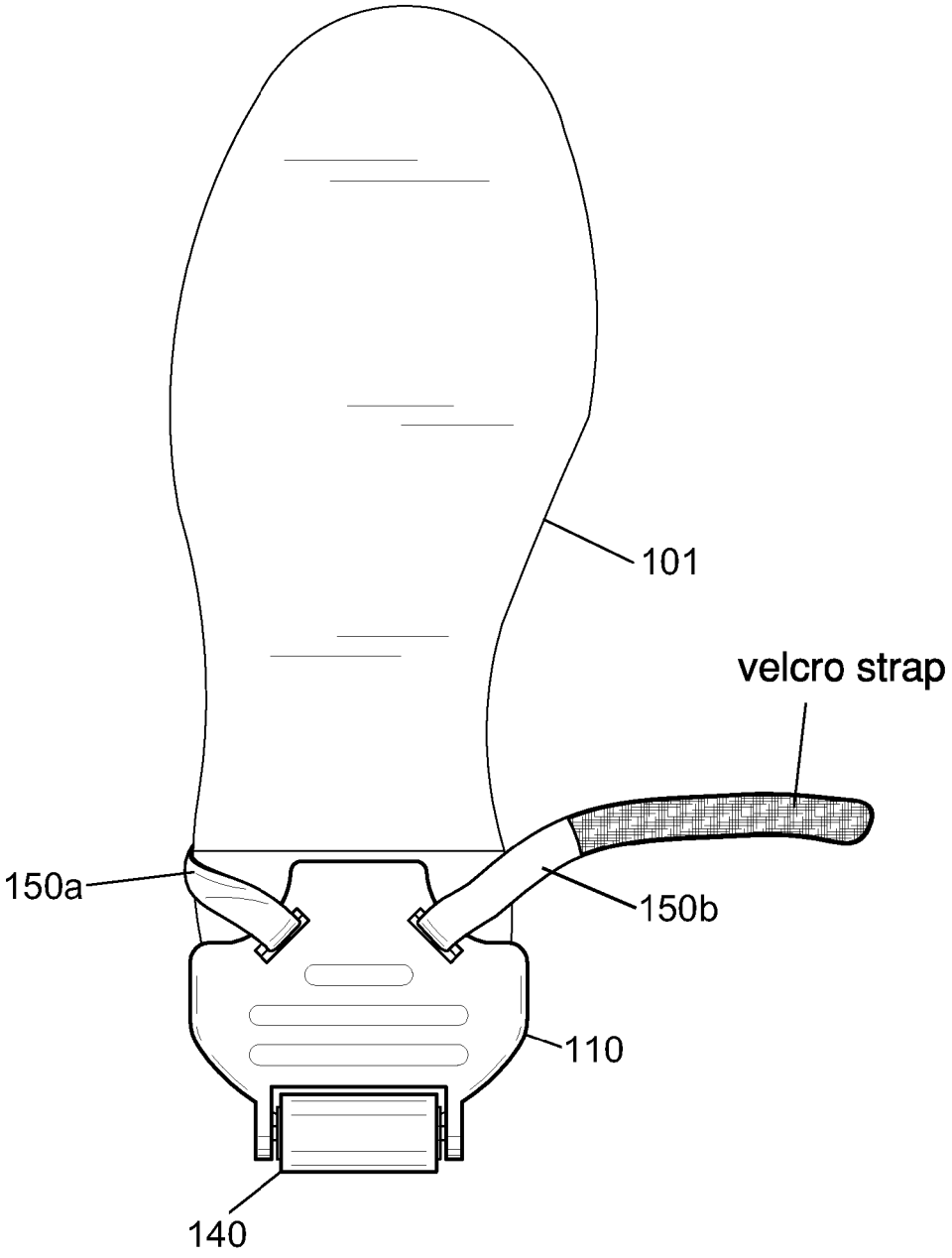
FIG. 5 is a bottom in-use view of the system of the present invention (e.g., a men's size).
Figure 6:
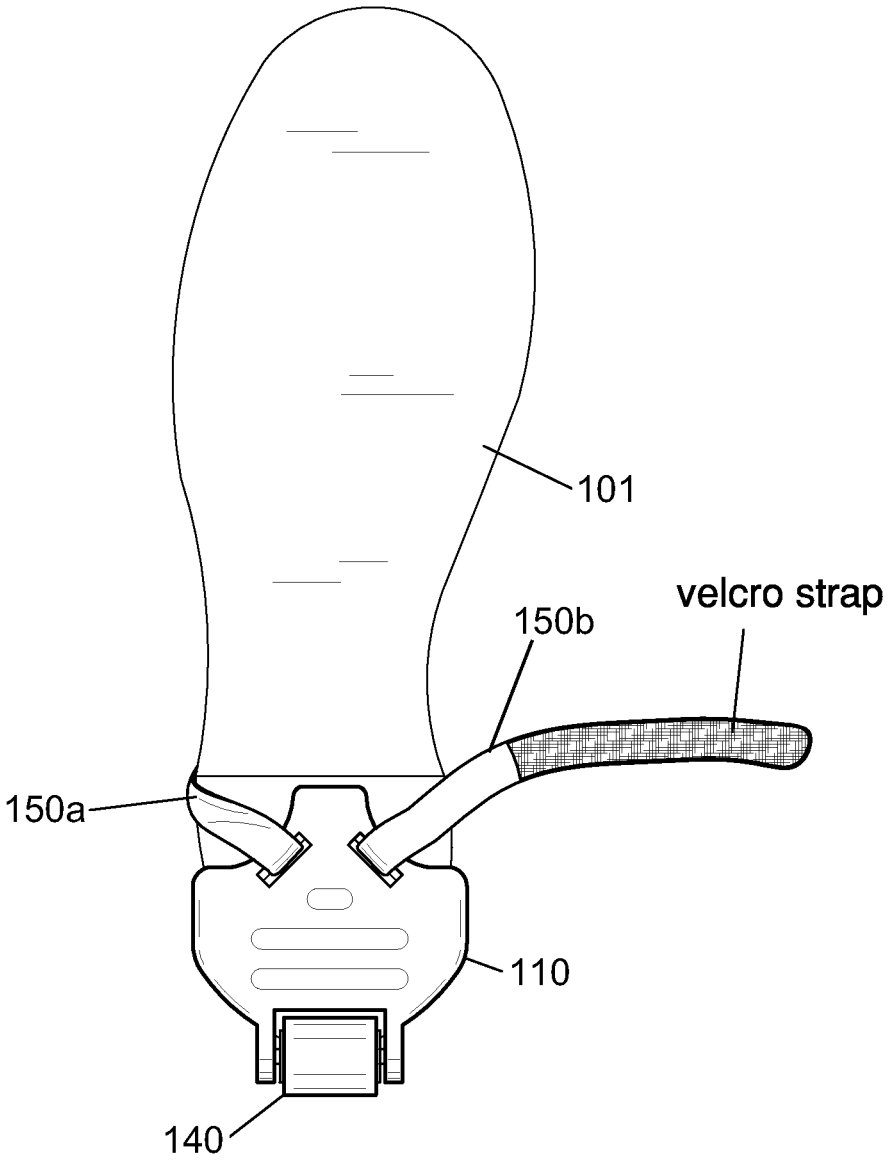
FIG. 6 is a bottom in-use view of the system of the present invention (e.g., a women's size).

As shown in FIG. 1, in some embodiments, the system 100 further comprises a first side panel 118*a* and a second side panel 118*b* each connected to the base panel 110 and the back panel 120 such that the panels 110, 118, 120 form a mold around the back area of a shoe 101 (e.g., see FIG. 4). In some embodiments, the front edge 111 of the base panel 110 extends past the side panels 118 (e.g., see FIG. 1).

Figure 2:
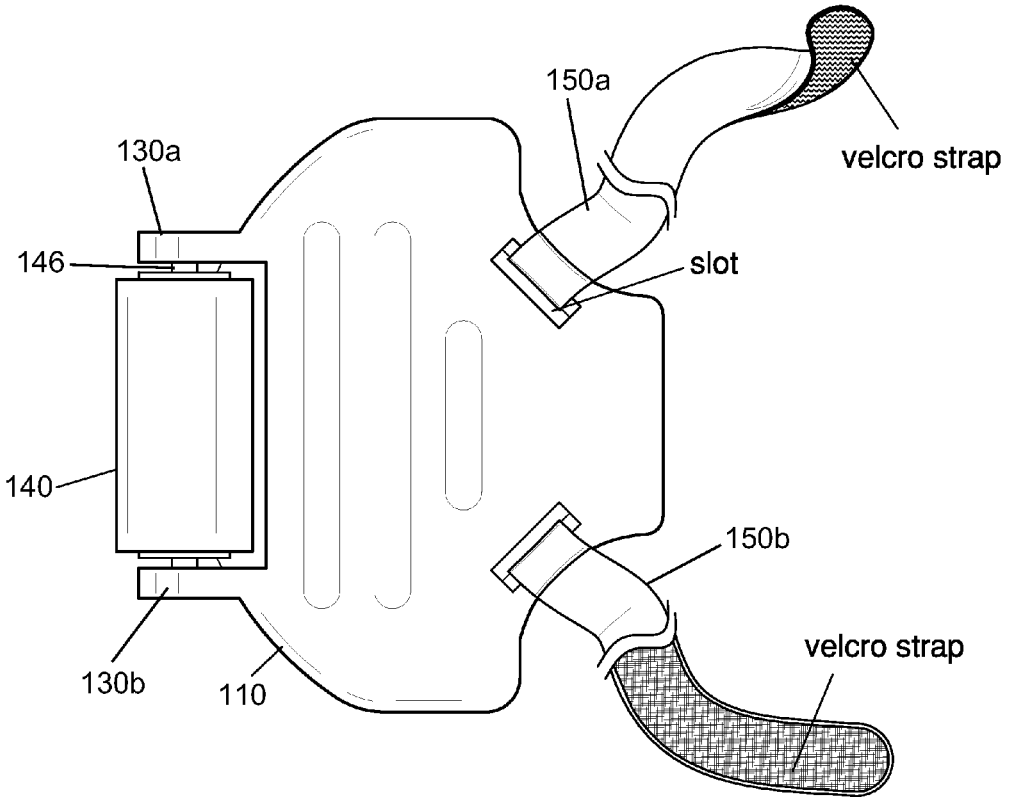
FIG. 2 is a bottom view of the system of the present invention.
Figure 3:
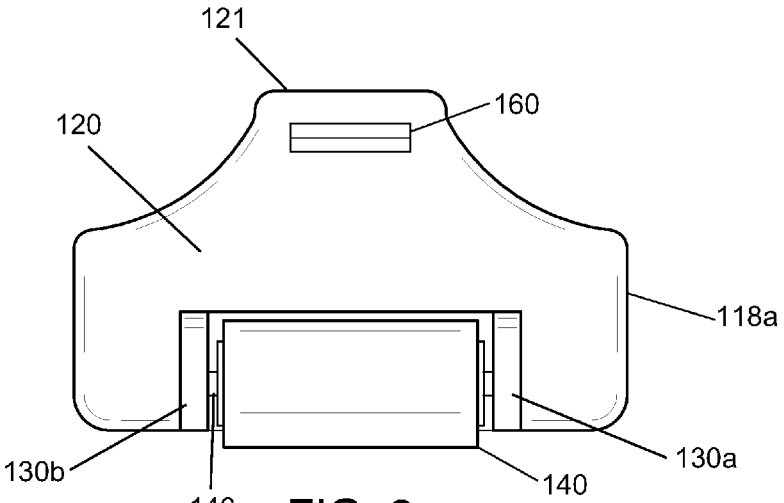
FIG. 3 is a back view of the system of the present invention.

The system 100 is attachable to a shoe 101 via an attachment means. As shown in FIG. 2, in some embodiments, the attachment means comprises a hook and loop fastener mechanism, a clip mechanism, a hook mechanism, a magnet mechanism, a strap mechanism, a snap mechanism, the like, or a combination thereof. In some embodiments, a first half strap 150*a* is attached to the base panel 110 (e.g., near the front edge 111 of the base panel 110) at or near a first side and a second half strap 150*b* is attached to the base panel 110 e.g., near the front edge 111 of the base panel 110) at or near a second side. The half straps 150 can engage each other (e.g., via a hook-and-loop fastener, a snap, a button, a magnet, a clip, etc.) to secure the system 100 to the shoe 101.

In some embodiments, a slot 160 is disposed in the back panel 120 at or near the top edge 121. The slot 160 may be used to accept a secondary strap 166 for helping to secure the system 100 to a shoe 101 (e.g., see FIG. 4).

The system 100 of the present invention may be constructed in a variety of sizes. For example, in some embodiments, the system 100 is constructed in a size appropriate for men's shoe sizes and a size appropriate for women's shoe sizes (e.g., smaller in width than the size for men).

Without wishing to limit the present invention to any theory or mechanism, it is believed that the system 100 of the present invention is advantageous because it is a separate assembly that can be attached to any shoe.

The disclosures of the following U.S. patents are incorporated in their entirety by reference herein: U.S. Pat. No. 5,273,304; U.S. Design Pat. No. D459777; U.S. Pat. No. 7,621,540; U.S. Pat. No. 7,735,847; U.S. Patent Application No. 2004/0239056; U.S. Patent Application No. 2010/0051372.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A shoe mobility system comprising:

(a) a base panel having a front edge and aback edge;

(b) a back panel having a top edge and a bottom edge, the bottom edge is connected to the back edge of the base panel, the back panel and the base panel are at an angle with respect to each other;

(c) a first flange extending backwardly from a first side of the back panel near an intersection of the base panel and the back panel and a second flange extending backwardly from a second side of the back panel near the intersection of the base panel and the back panel;

(d) an axle spanning the flanges;

(e) a wheel rotatably attached to the axle; and (f) a first half strap disposed on the base panel at or near a first side of the base panel, and a second half strap disposed on the base panel at or near a second side of the base panel, the half straps can engage each other to secure the system to a shoe.

2. A shoe mobility system comprising:

(a) a base panel having a from edge and a back edge;

(b) a back panel having a top edge and a bottom edge, the bottom edge is connected to the back edge of the base panel, the back panel and the base panel are at an angle with respect to each other;

(c) a first flange extending backwardly from a first side of the back panel near an intersection of the base panel and the back panel and a second flange extending backwardly from a second side of the back panel near the intersection of the base panel and the back panel;

(d) an axle spanning the flanges;

(e) a wheel rotatably attached to the axle; and (f) a first side panel and a second side panel each connected to the base panel and the back panel such that the panels form a mold around a back area of a shoe.

3. A shoe mobility system comprising:

(a) a base panel having a from edge and a back edge (b) a back panel having a top edge and a bottom edge, the bottom edge is connected to the back edge of the base panel, the back panel and the base panel are at an angle with respect to each other;

(c) a first flange extending backwardly from a first side of the back panel near an intersection of the base panel and the back panel and a second flange extending backwardly from a second side of the back panel near the intersection of the base panel and the back panel;

(d) an axle spanning the flanges;

(e) a wheel rotatably attached to the axle; and (f) a slot disposed in the back panel at or near the top edge, the slot is adapted to accept a secondary strap.

* * * * *